US007128147B2

(12) United States Patent
Marcin et al.

(10) Patent No.: US 7,128,147 B2
(45) Date of Patent: Oct. 31, 2006

(54) MODULAR LINER HANGER

(75) Inventors: Jozeph R. Marcin, St. Albert (CA); James F. Wilkin, Sherwood Park (CA)

(73) Assignee: Watherford/Lamb Inc., Houston, TX (US)

( * ) Notice: Subject to any disclaimer, the term of this patent is extended or adjusted under 35 U.S.C. 154(b) by 4 days.

(21) Appl. No.: 11/074,127

(22) Filed: Mar. 7, 2005

(65) Prior Publication Data

US 2005/0145382 A1 Jul. 7, 2005

Related U.S. Application Data

(63) Continuation of application No. 10/041,974, filed on Jan. 7, 2002, now abandoned.

(51) Int. Cl.
*E21B 23/02* (2006.01)
*E21B 17/02* (2006.01)
*E21B 43/10* (2006.01)

(52) U.S. Cl. ..... 166/208; 166/242.6; 403/204; 403/332; 403/375; 403/408.1

(58) Field of Classification Search ..... 166/208, 166/209, 216; 403/204, 332, 375, 408.1, 403/DIG. 7

See application file for complete search history.

(56) References Cited

U.S. PATENT DOCUMENTS 4,762,177 A * 8/1988 Smith, Jr. ..... 166/216

* cited by examiner

*Primary Examiner*—Zakiya W. Bates
(74) *Attorney, Agent, or Firm*—Howrey LLP

(57) ABSTRACT

A liner hanger having a mechanical coupling between a liner hanger body and one or more cones is disclosed. The cones are coupled to the liner hanger body to resist axial and relative rotational movement without welding the cones to the hanger body, and without the need to use integral cones. In general, the mechanical coupling includes a hanger body or casing mandrel, a cone assembly journaled on the casing mandrel, at least one slot or groove in an outer wall of the casing mandrel, and at least one partially or fully annular slot on the inside surface of the cone assembly oriented to correspond with the groove(s) in the outer wall of the hanger body. At least one wire, or one or more bearings, is situated in the corresponding slot and the groove. The wire engages the flanks of the slot and groove sufficiently to resist axial or rotational movement of the cones relative to the hanger body.

4 Claims, 5 Drawing Sheets

150
220
260
252
226
250
258
228
270
292
262
290
230
296
232
300
364
360
362

MODULAR LINER HANGER

This application is a continuation of U.S. application Ser. No. 10/041,974, filed Jan. 7, 2002 now abandoned.

BACKGROUND OF THE INVENTION

This invention relates generally to setting liner hangers during well completion or maintenance operations. In particular, the invention is directed to a liner hanger in which the cones of the liner hanger are non-integral to the barrel and attached by mechanical means without welding.

Generally, in a producing well, casing (lengths of steel pipe joined together) runs from the surface to a specified depth in the wellbore. The casing generally has a large diameter. It is installed and cemented in place to seal off drilling and circulating fluids from the borehole and prevent commingling of well fluids, and to prevent the walls of the borehole from caving. The casing string is generally hung from a hanger on the surface.

A liner is a length of casing that is hung inside existing casing. Unlike the casing string, the liner generally does not extend to the surface, but is anchored, suspended, and supported by a liner hanger that is installed near the bottom of the casing in which the liner is suspended, or near the location where the liner string is desired to isolate problems such as from other zones such as lost circulation or high pressure. The liner also provides capital savings in reducing the cost of the steel pipe needed since it does not run to the top of the well.

A liner hanger holds the liner in place once the liner is in the desired location in the well, and carries the weight of the liner after it is hung off. Mechanical or hydraulic slips on the hanger hold the liner in place by gripping the inside wall of the casing in which the liner is suspended. Hangers may be set hydraulically by creating pressure in the hanger, activating hydraulic pistons that move the slips against the casing. During the running process the slips are retained in a retracted position. Once the liner is in the desired position, the slips are driven across the cones by the activation mechanism, which may be mechanical or hydraulic, thereby increasing the diameter of the slips and forcing the teeth on the outer surface into the casing. Liner hangers generally include one or more sets of cones and slips.

The cones are wedge-shaped sections on the liner hanger's outer wall. Generally in the past, the cones have been integral to the barrel of the liner hanger. For example, in a common type of prior art liner hanger the barrel is made of two piece construction, as shown in FIGS. 1A and 1B. A lower portion of the barrel is threaded onto an upper portion and acts as a hydraulic cylinder. The entire assembly contains a longitudinal throughbore that allows for the passage of fluids during the running process. The slips and cones are slotted to allow the passage of fluid in the annulus around the liner hanger during the running in/removal or cementing processes.

With the hydraulic version, when the liner hanger is in the desired position, the operator creates an increased pressure, generally by dropping a ball or dart into a ball seat or other receptacle in a landing collar below the liner hanger. At a particular increased pressure a setting piston moves upward to an extended position. The setting piston drives a setting sleeve, connected by one or more slip arms to the slips. This drives the slips, which expand out over the wedge-shaped cone pads until fully gripping the inside of the casing. Downward motion transfers the full liner weight through the cones and slips into the supporting casing.

Alternatively, the hanger can be mechanically set. In one such hanger, the work string attached to the liner hanger is rotated. Rotation may be right-hand set or left hand set depending on the desired embodiment. The rotation causes a J-Cage mechanism in contact with the casing to disengage a lug from the short leg of the J-Cage and allows the slips to align with the cones. Downward motion then allows the slips to expand over the cones and grip the casing's inner wall, transferring the weight of the liner to the supporting casing.

A disadvantage of such prior art liner hangers is that they must be constructed using a very thick-walled steel tube stock, for example a six inch inner diameter might require an eight inch outer diameter, in order for the wall to have sufficient thickness in the area of the cones and the cylinder once the steel tube is machined inside and out. This creates expense in the material, in the machining time, and in the construction.

Other liner hangers have been constructed with a single-piece mandrel or barrel. In this case, the cylinder or J-Cage is connected to the barrel using mechanical means such as set screws, wirelocks, or welding. The cones are generally integral to the barrel as described above, but in some prior art embodiments the cones may have been welded to the barrel, which adds cost and time to the production. In addition, because of the complexity and cost of the tool construction, it is impractical to create stock items.

Welding the cones or the cylinder to the barrel or casing mandrel requires multiple welds. These welds add time and expense to the manufacture of the liner hanger. More importantly, welding can affect the metallurgy of the barrel, making the welded area subject to attack, for example by corrosive well fluids. As such, welding to the barrel or to a casing mandrel is at minimum undesirable, and may be prohibited under certain industry standard regulations. As such, mechanical connections are preferable.

The disadvantages of two-piece liner hanger, and the single-piece welded liner hanger, are overcome by the present invention.

SUMMARY OF THE INVENTION

It is an aspect of the current invention that a liner hanger, whether mechanical or hydraulic, may be constructed in a modular fashion. The cones are attached to a barrel or mandrel in a manner that is mechanical, does not require welding, and is highly resistant to axial movement. It is a further aspect of the invention that the mechanical connection is made using non-adhesive components combined in such a manner that they will resist the high temperatures, high pressures, and corrosive fluids and gases that may be encountered in the well.

In the embodiment described herein, the present invention provides a high-strength non-welded mechanical connection between the cones of a liner hanger and a barrel or mandrel. As such, the liner hanger can be built using standard stock casing, reducing the over-all expense. In general, the liner hanger includes at least one set of cones and slips.

One or more grooves or channels are cut in an outer wall of the barrel. In preferred embodiments, the groove or channel is sufficiently shallow to avoid significantly thinning the wall thickness of the barrel. The inside surface of the cones contains at least one partially or fully annular slot or groove oriented to correspond with the groove(s) in the outer wall of the casing mandrel.

At least one lock is situated in the corresponding slot and the groove. The lock engages the flanks of the slot and groove sufficiently to resist shears loads applied by the weight of the liner that is hung off, and axial movement during running in the hanger. In a preferred embodiment, the lock is one or more wires, although other mechanical locking devices may be installed to provide the same function.

The cones of the liner hanger, as well as the cylinder and slips, can be easily installed on, or removed from the barrel. A standard size barrel can accommodate cones and slips of various sizes as needed for the characteristics of a particular well, the piston or J-Cage area needed, and the weight of the particular length of liner to be hung off the liner hanger. As such, the system of the current invention provides a liner hanger that is constructed of separately built and stored modules, and one that uses mechanical non-welded connections.

DESCRIPTION OF ILLUSTRATIVE EMBODIMENTS

Figure 1A:
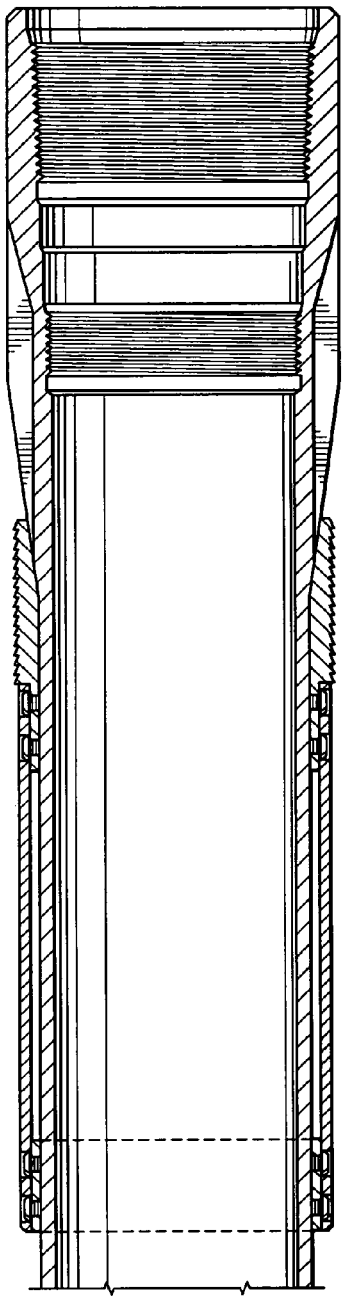
FIG. 1A (PRIOR ART)
FIG. 1A is an elevation of an upper portion of a prior art liner hanger with a two-piece barrel.
Figure 1B:
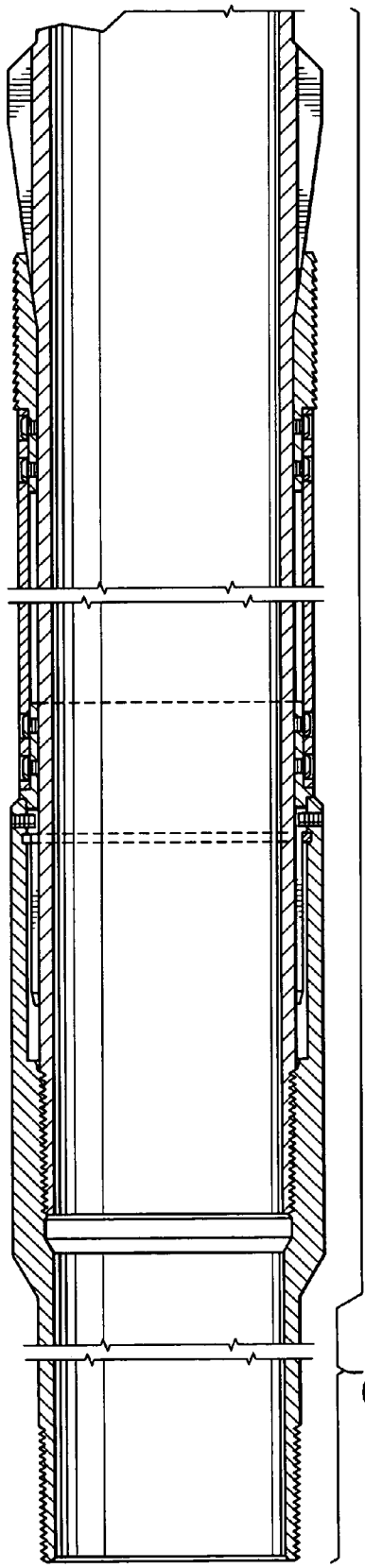
FIG. 1B (PRIOR ART)
FIG. 1B is an elevation of a lower portion of a prior art liner hanger with a two-piece barrel.
Figure 2A:
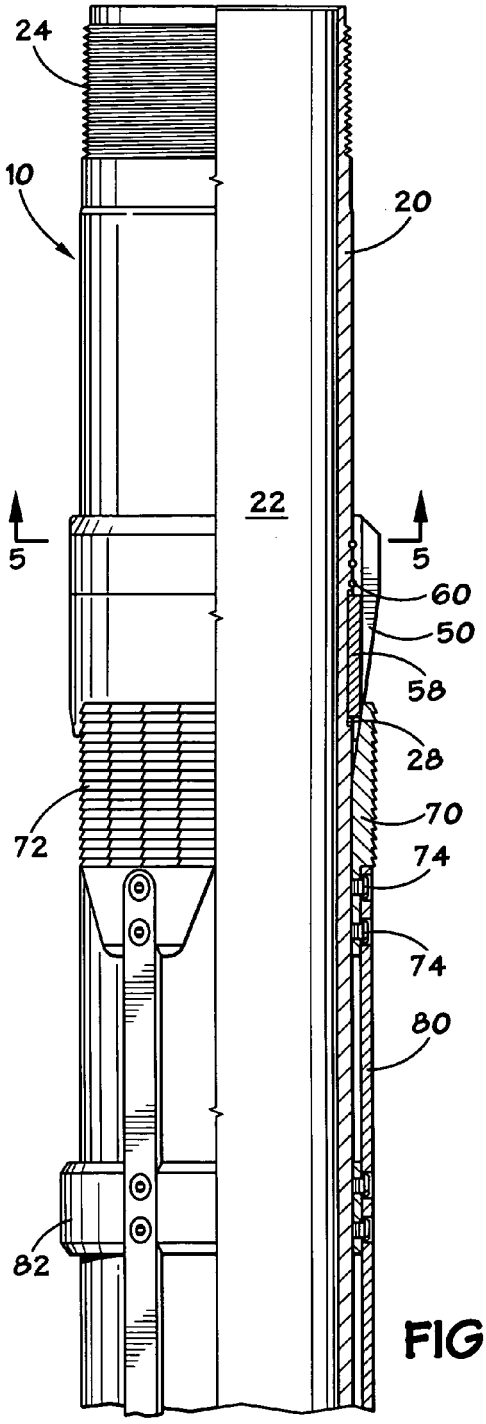
FIG. 2A is a partial sectional elevation of an upper portion of a hydraulically actuated modular liner hanger.
Figure 2B:
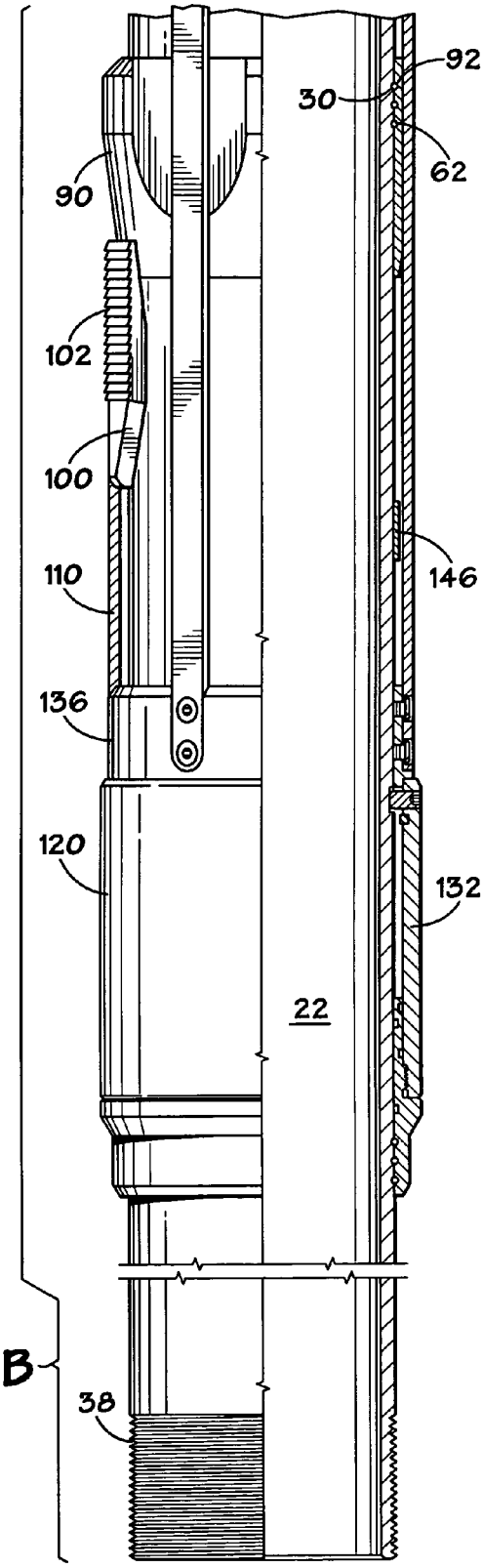
FIG. 2B is a partial sectional elevation of a lower upper portion of a hydraulically actuated modular liner hanger.

In FIGS. 2A and 2B, an upper and lower portion of a hydraulic-set modular liner hanger 10 are shown. Partial figures are meant to show certain aspects of embodiments of the invention, and are not necessarily continuous.

The modular liner hanger comprises a body or barrel 20, which may also be called a mandrel or casing mandrel, or a liner hanger body. Barrel 20 is generally cylindrical and contains a generally cylindrical internal through bore 22. The barrel may be made out of standard size and standard material casing that is well known in the oilfield practice, or can be made out of specialty pipe sizes or materials. At one end the barrel 20 may contain a tapered and threaded portion 24 for connection to a running string, liner packer, and/or liner setting tools (not shown).

A first set of cones or cone pads 50 is journalled about the barrel 20. Cones 50 are separately machined pieces, and can be constructed of various materials and in various sizes as desired for a particular application. Cones 50 may include two or more cone pads spaced around the circumference; three are shown in the embodiment in the figures herein.

It is a particular aspect of the current invention to provide a modular constructed liner hanger wherein the cones and cylinders are mechanically joined to the barrel in a manner that restricts both axial movement and rotation between the cones and cylinder relative to the barrel. For this reason, prior liner hangers have generally been constructed with the cones integral or welded to the casing mandrel, and the cylinder constructed of a separate barrel section with a threaded connection. The present invention provides a one-piece construction and avoids welding, or reduces the total number of welds.

Figure 3:
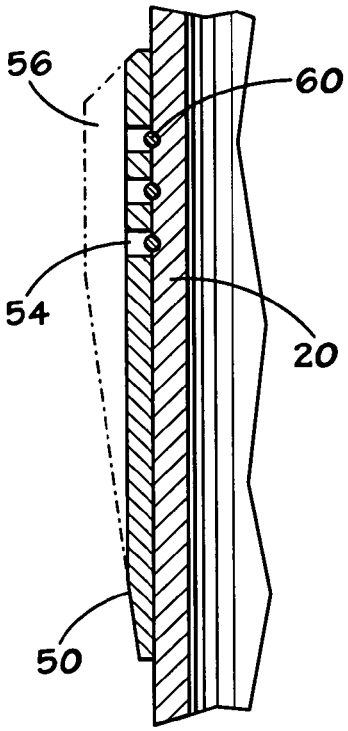
FIG. 3 is a partial sectional elevation of cones connected to the liner hanger.
Figure 4:
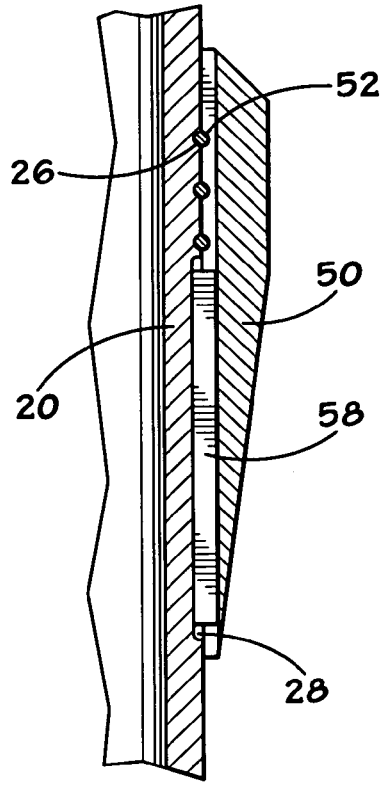
FIG. 4 is a second partial sectional elevation of cones connected to the liner hanger, shown at a different radial location.
Figure 5:
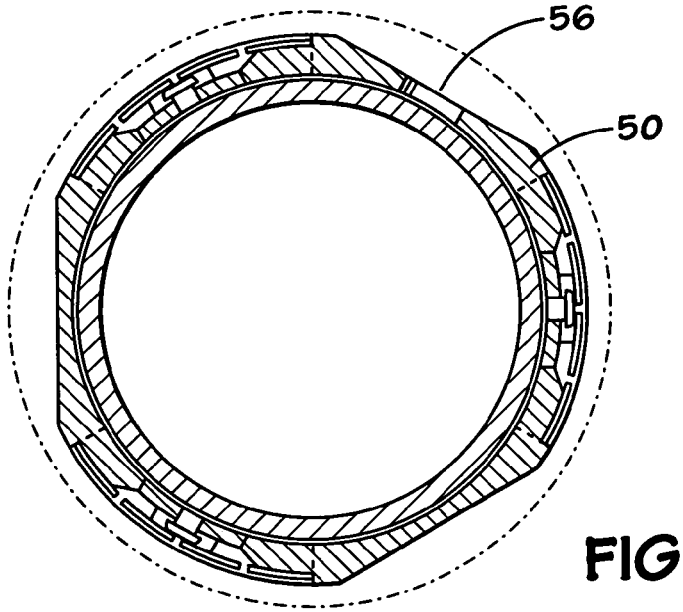
FIG. 5 is a cross section of the hydraulically actuated modular liner hanger shown in FIG. 2.

In one embodiment of the current invention, as shown in FIGS. 2A, 3, and 4, one or more grooves, or a series of radial grooves 26, are cut in the external wall of the barrel 20. Grooves 26 need not be deeply cut into the outside diameter of the barrel 20, and could be little more than indentations, aligned with a series of one or more corresponding annular grooves 52 in the inner wall of the cones 50. Each annular groove 52 is connected to a lateral bore 54 between the groove and the external surface of the cones 50. Referring now to FIGS. 3 and 5, cones 50 also contain a series of concave portions 56 that allow the passage of fluid. Concave portions 56 may alternatively be a series of axial slots, bores, or other means for allowing flowby of a sufficient volume of fluid. In other embodiments, cone pads 50 may be a single cone or may be multiple disjointed cones individually installed.

As shown in FIGS. 2A and 3, with the cones 50 journalled about the barrel 20, and the grooves or indents 26 and 52 aligned, a wire or series of wires 60 can be disposed in the grooves 26 and 52. Wires 60 can be installed through the lateral bores 54, cut to appropriate lengths, and the opening of the lateral bores 54 closed if desired.

Wires 60 bear on the flanks of grooves 26 and 52 to resist axial movement of the cones 50 relative to the barrel 20. In a preferred embodiment, the yield point of wires 60 will be greater than the yield point of the barrel 20 and the cones 50.

In alternate embodiments, grooves 26 and 50 could be single helical grooves, and a single wire 60 could be threaded into the helical grooves. In addition, the grooves could be full or partial channels, keyways, or other passageways. Wires 60 could be replaced by a series of ball bearings sized for the grooves or other passageways, roller-type bearings, or keys.

A keyway 28 is machined into the outer wall of barrel 20. Key 58 is installed in a the keyway and a corresponding slot in the cones 50 to resist relative rotation and to keep the cones properly aligned. In an alternate embodiment, the cones may not be keyed to the barrel, thus allowing relative rotation.

Referring again to FIG. 2A, journalled below the cones 50 are a corresponding first set of slips 70. Slips 70 contain a serrated portion 72. The first set of slips 70 is connected to a first end of one or more slip arms 80 by screws 74, or by other known fastening means.

Slip arm 80 extends from the first set of slips 70 to a hydraulic setting mechanism, or to the second set of slips 100 located lower on the barrel 20. The slip arms 80 transfer the initial setting force from the hydraulic setting mechanism. Although two sets of slips are shown, in other embodiments there is only one set of slips, or there may be three or more. Such variations are determined based on the required liner length, hanging capacity, and well conditions, and/or to minimize stress in the supporting casing. The slip arms may be radially offset, as in the embodiment shown.

A slip arm support ring 82 may be installed between the barrel 20 and the slip arm 80 to stiffen the slip arm 80 as may be necessary based on the arrangement of, and distance between, cones 50 and 90. The second set of cones 90 may be radially offset from the first set of cones 50.

Similar to the attachment of cones 50 to the barrel 20, in the embodiment shown, grooves 30 are cut in the external wall of the barrel 20. Grooves 30 are aligned with a second series of one or more corresponding annular grooves 92 in the inner wall of the second set of cones 90. Each groove 92 may be connected to a lateral bore (not shown but, which are similar to bore 54) between the groove 92 and the surface of the cones 90. Cones 90 are journalled about the barrel 20, and the grooves 30 and 92 are aligned so that a wire or series of wires 62 can be disposed in the grooves 30 and 92. Wires 62 may have a higher yield point relative to the barrel 20 and the cones 90. Grooves 30 and 92 could be single helical grooves with a single wire 62. The grooves could be full or partial channels, keyways, or other passageways. Wires 62 could be replaced by a series of ball bearings sized for the grooves or other passageways, roller-type bearings, or wires or keys.

A second keyway (not shown) may be machined into the outer wall of barrel 20, and a second key may be installed in the keyway and a mating slot in the cones 90 to resist relative rotation and to keep the cones 90 properly aligned.

Second set of slips 100 may be radially offset from the first set of slips 70, but is aligned with the second set of cone pads 90. The second set of slips 100 also contains a serrated portion 102. The serrated portions 72 and 102 of the slips 70 and 100 are sufficiently hardened to allow setting into the particular grade of casing in the well.

The second set of slips 100 is coupled to a second slip arm 110 by any mechanical means, for example, the screws 112 shown. Slip arms 80 and 100 are coupled to a setting mechanism 120. In one embodiment, setting mechanism 120 includes limit ring 135. Slip arms 80 and 110 are coupled to the setting sleeve 136.

Figure 6:
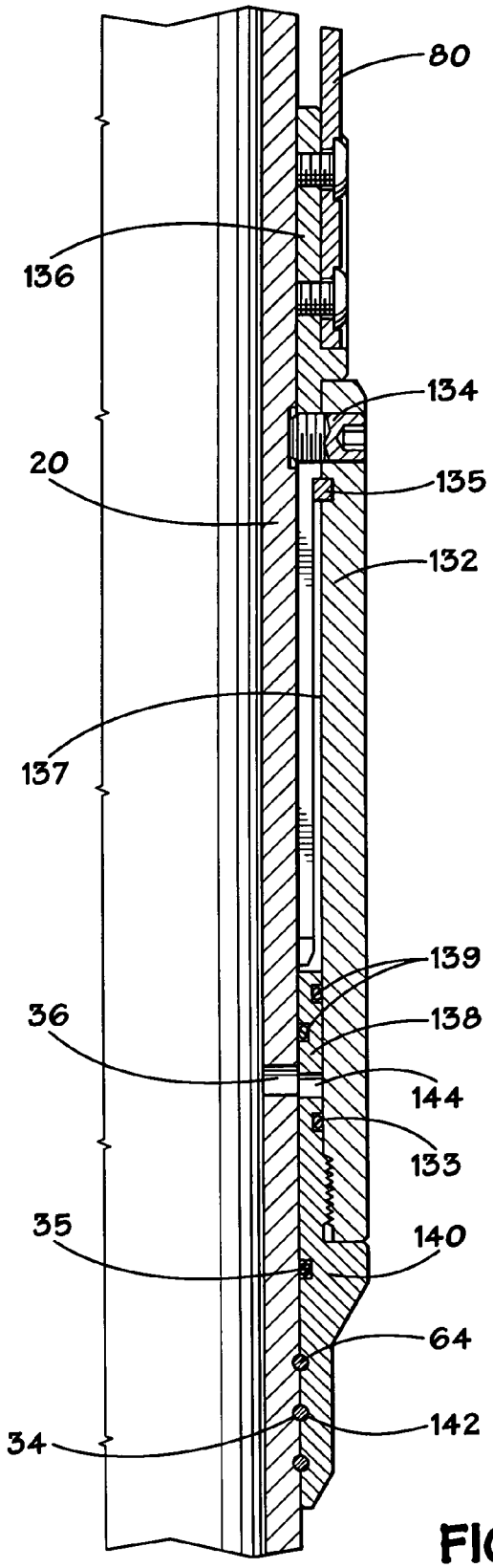
FIG. 6 is a partial sectional elevation of a hydraulic actuation mechanism of the modular liner hanger.

As shown in FIGS. 2B and 6, a cylinder 132 is also journalled about the barrel 20. Cylinder 132 has a counterbore area that, together with the outer wall of barrel 20, piston 138 and associated seals 139, seal 133, and gage ring 140 create a chamber 144. A port 36 in barrel 20 allows the passage of fluid from the throughbore 22 to chamber 144. Thus when the hydraulic liner hanger 10 has reached its desired position, a ball or dart is dropped and lands in a seat or receptacle resulting in a pressure increase as additional fluid is pumped down the string. The cylinder 132 may be shear pinned to actuate at a predetermined pressure value. At the desired pressure, the piston 138 moves upward, driving the setting sleeve 136 upward. Setting sleeve 136 is slotted such that the slots 137 allow travel upward and downward, but set screws 134 located in the slots 137 restrain rotation of the setting sleeve 136 relative to the barrel 20. With the piston 138 travelling upward, the force is transferred from the setting sleeve 136 to the slip arms 80 and 110. This causes slips 70 and 100 to come in contact with the cones 50 and 90, and to be expanded outward until serrated edges 72 and 102 and in gripping relation with the casing. In conjunction with shoulder 146, limit ring 135 provides a backup to set screws 134 in restraining the maximum travel distance for the slip arms 80 and 110.

Gage ring 140 provides the base for the chamber 144. Barrel 20 contains a third set of grooves 34 cut in the external wall of the barrel 20. Grooves 34 are aligned with another series of one or more corresponding annular grooves 142 in the inner wall of the gage ring 140. Each groove 142 may be connected to a lateral bore. Gage ring 140 is journalled about the barrel 20 such that the grooves 34 and 142 are aligned and a third wire or series of wires 64 can be disposed in the grooves 34 and 142. Wires 64 may have a higher yield point relative to the barrel 20 and the gage ring 140. Grooves 34 and 142 could be single helical grooves with a single wire 64. The grooves could be full or partial channels, keyways, or other passageways. Wires 64 could be replaced by a series of ball bearings sized for the grooves or other passageways, roller-type bearings, or wires.

Setting mechanism 120 and/or cylinder 132 may have an area of larger outside diameter to protect the slips 70 and 100 and slip arms 80 and 110 during running of the liner hanger 10. In addition, at the distal end of barrel 20 there may be a tapered and threaded portion 38 for connection to a liner packer, and/or liner setting tools (not shown).

As can be seen, the cones 50 and 90, and the gage ring 140 of setting mechanism 120 are connected to the barrel or casing mandrel 20 by means of one or more wirelocks, or similar mechanical type connections, without the need for welding. It can also be seen that the body of the liner hanger 20 has a generally uniform wall thickness in the portion of the liner hanger where the cones 50 and 90 and the gage ring 140 are journalled and coupled, thus the tool need not be manufactured from heavy wall pipe.

Figures 7A, 7B:
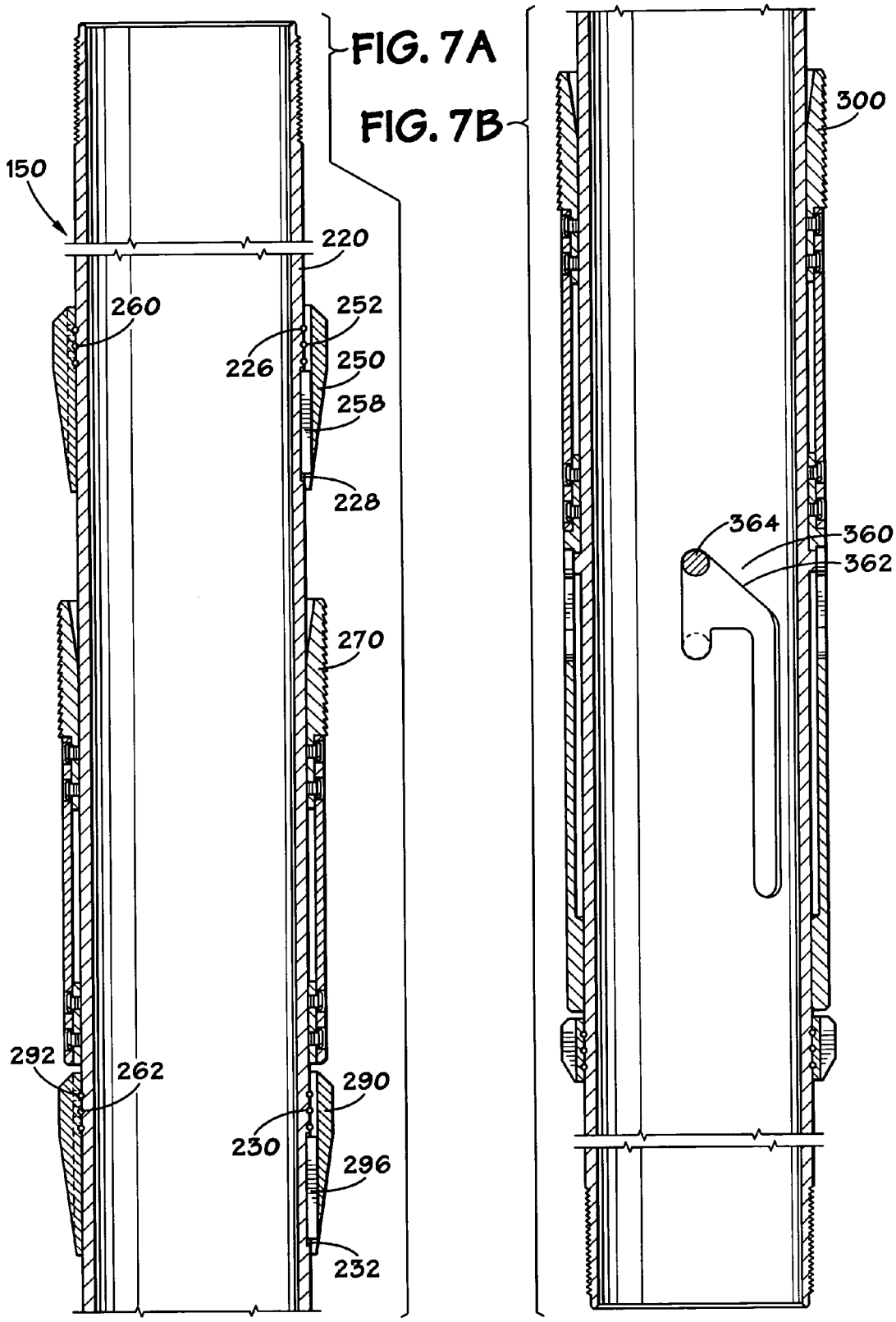
FIG. 7A is a sectional elevation of an upper portion of a mechanically actuated modular liner hanger.
FIG. 7B is a sectional elevation of a lower portion of a mechanically actuated modular liner hanger.

In an embodiment shown in FIGS. 7A and 7B, one possible version of a mechanical set liner hanger in accordance with the current invention is illustrated. Mechanical set liner hanger 150, is comprised of barrel 220, one or more set of cone pads 250 and 290, and slips 270 and 300 associated with the cone pads 250 and 290. The cones 250 and 290 are attached to the barrel 220 using mechanical non-welded connections, which can be a wirelock mechanism as detailed in FIGS. 3 and 4. The cones 250 and 290 contain one or more grooves 252 and 292 that are aligned with channels or grooves 226 and 230 in the outer wall of the barrel 220. One or more wires 260 and 262, bearings, or other mechanical apparatus sufficiently stress resistant, are installed in the mating grooves 226 and 252, and 230 and 292, in the cones and barrel. Locked in this manner, the cones 250 and 290 are held in a manner that resists axial loads and restricts axial movement of the cones 250 and 290 relative to the barrel 220. Cones 250 and 290 may be keyed to the barrel 220 using keys 258 and 296 installed in the barrel keyways 228 and 232, to resist rotation of the cones relative to the barrel.

The slips 270 and 300 in mechanical set liner hanger 150 are driven by J-Cage 360. The J-Cage 360 contains a J-shaped slot 362. A lug 364 is positioned within the J-shaped slot 362. During the running of the mechanical set liner hanger 150, the lug 364 is held against the short leg of the slot 362 because of the drag forces on the J-Cage 360 which is in contact with the casing (not shown). When the hanger is in the desired location in the well, the mechanical hanger 150 is set by lifting the work string to release the lug 364 from the short leg of the slot 362. The mechanical hanger 150 is then rotated, to the right for right-hand set, and to the left if left-hand set, to shift the lug to the long leg of the J-shaped slot 362 and to align the slips 270 and 300 with the cones 250 and 290. With the cones 250 and 290 and slips 270 and 300 aligned, downward motion of the work string brings the cones 250 and 290 into contact with the slips 270 and 300, expanding the serrated edges of the slips 270 and 300 into the casing wall. The weight of the liner is transferred through the slips 270 and 300 into the surrounding casing to support the liner.

While the apparatus and methods of this invention have been described in terms of preferred and illustrative embodiments, it will be apparent to those of skill in the art that variations may be applied without departing from the concept and scope of the invention. All such similar substitutes and modifications apparent to those skilled in the art are deemed to be within the scope and concept of the invention.

What is claimed is:

1. A liner hanger comprising:

a casing mandrel;

a cone assembly journaled on the casing mandrel;

a slot on an outer wall of the casing mandrel;

a groove, at least partially annular, on an inside surface of the cone assembly oriented with the slot;

at least one wire situated in the slot and the groove adapted to resist any axial movement of the cones relative to the casing mandrel.

2. The tool assembly of claim 1 wherein there are a plurality of slots, and a plurality of grooves oriented with the slots.

3. The tool assembly of claim 2 wherein there is a single helical slot oriented with a single helical groove.

4. A mechanical coupling between a liner hanger body and one or more cones, the coupling comprising:

at least one indent in the liner hanger body outer wall;

at least one indent in an inner surface of the cones; and a wire radially located in the indent in the liner hanger body outer wall and in the indent in the inner surface of the cones to resist any axial movement of the cones relative to the liner hanger body.

* * * * *

UNITED STATES PATENT AND TRADEMARK OFFICE

CERTIFICATE OF CORRECTION

PATENT NO. : 7,128,147 B2
APPLICATION NO. : 11/074127
DATED : October 31, 2006
INVENTOR(S) : Jozeph R. Marcin and James F. Wilkin It is certified that error appears in the above-identified patent and that said Letters Patent is hereby corrected as shown below:

On the title page (73) correct Assignee to read:
Assignee: Weatherford/Lamb, Inc. (Houston, TX)

Signed and Sealed this

Sixth Day of March, 2007

JON W. DUDAS
*Director of the United States Patent and Trademark Office*